US006039166A

United States Patent [19]

Abe et al.

[11] Patent Number: 6,039,166

[45] Date of Patent: Mar. 21, 2000

[54] METAL DISC EJECTOR

[75] Inventors: Hiroshi Abe; Motoharu Kurosawa, both of Saitama, Japan

[73] Assignee: Asahi Seiko Kebushiki Kaisha, Japan

[21] Appl. No.: 08/933,578

[22] Filed: Sep. 19, 1997

[30] Foreign Application Priority Data

| | | | |
|---|---|---|---|
| Sep. 20, 1996 | [JP] | Japan | 8-285813 |
| Dec. 17, 1996 | [JP] | Japan | 8-359586 |
| Jan. 10, 1997 | [JP] | Japan | 9-032548 |

[51] Int. Cl.[7] ..... G07D 5/08

[52] U.S. Cl. ..... 194/317; 453/57

[58] Field of Search ..... 194/317, 318; 453/32, 33, 34, 35, 49, 50, 57

[56] References Cited

U.S. PATENT DOCUMENTS

| | | | |
|---|---|---|---|
| 3,788,440 | 1/1974 | Propice et al. . | |
| 4,476,884 | 10/1984 | Gonzalez | 453/57 |
| 5,074,434 | 12/1991 | Maki | 221/265 |
| 5,306,206 | 4/1994 | Abe | 453/57 |

FOREIGN PATENT DOCUMENTS

| | | | |
|---|---|---|---|
| 0 137 265 A2 | 4/1985 | European Pat. Off. . | |
| 0 204 405 A2 | 12/1986 | European Pat. Off. . | |
| 0 295 862 A2 | 12/1988 | European Pat. Off. . | |
| 0 596 612 A2 | 5/1994 | European Pat. Off. . | |
| 0 676 729 A1 | 10/1995 | European Pat. Off. . | |
| 2542475 | 9/1984 | France | 453/57 |
| 36 02 291 A1 | 7/1987 | Germany . | |
| 63-36040 | 7/1988 | Japan . | |
| 3-158988 | 7/1991 | Japan . | |
| 8-110960 | 4/1996 | Japan . | |
| 2185341 | 7/1987 | United Kingdom | 453/57 |
| 2 198 274 | 6/1988 | United Kingdom . | |
| 2276483 | 9/1994 | United Kingdom | 194/317 |
| WO 91/06928 | 5/1991 | WIPO . | |

*Primary Examiner*—F. J. Bartuska
*Attorney, Agent, or Firm*—McGlew and Tuttle, P.C.

[57] ABSTRACT

A disc ejector including a hopper for storing a multiplicity of deposited metal discs; a rotary disc for trapping these discs one by one and transporting them towards an exit; structure for forcing the discs out of the rotary disc one by one at the exit;

a rotary sweeper for removing the discs from the rotary disc;

structure for receiving the removed discs and guiding them to a predetermined reference point;

a check device provided near the reference point for determining if the disc is genuine; and a gate for selecting true discs from false disks, wherein true and false discs are accordingly ejected from separate outlets.

13 Claims, 12 Drawing Sheets

COVER SECTION OF THE SECOND METAL DISC EJECTOR

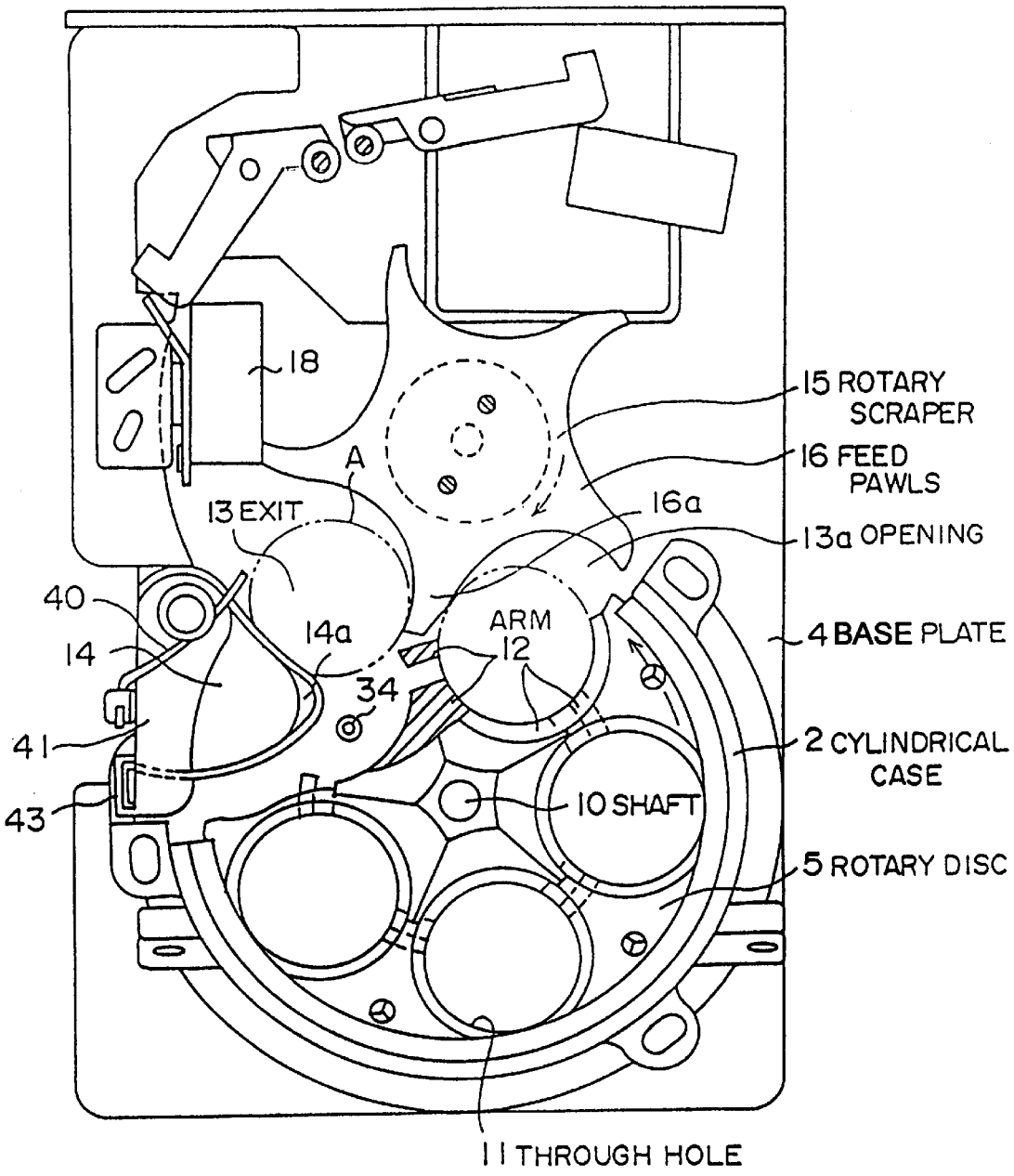
(PRIOR ART)
FIG. 1 A MAIN BODY OF A CONVENTIONAL DISC EJECTOR

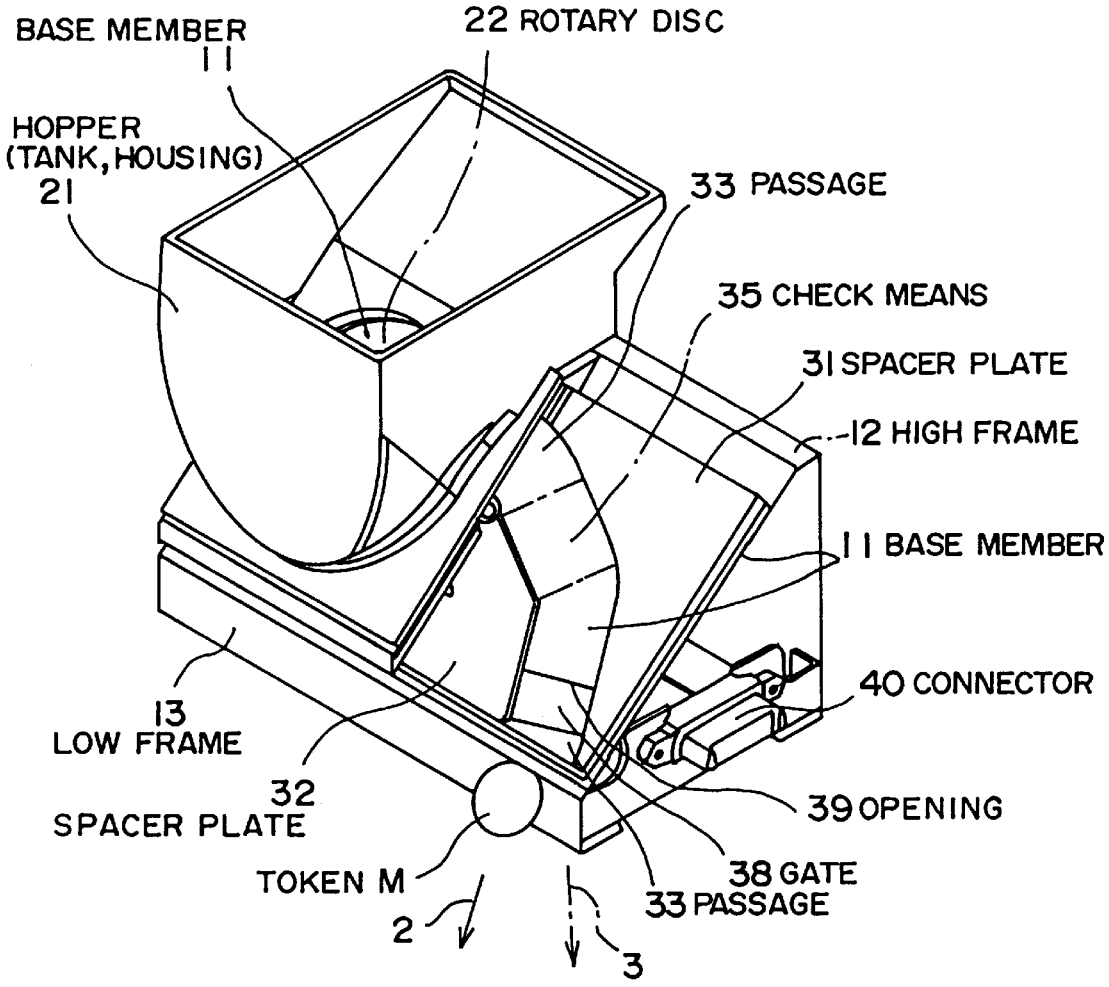
FIG. 2 FIRST METAL DISC EJECTOR ACCORDING TO THE INVENTION

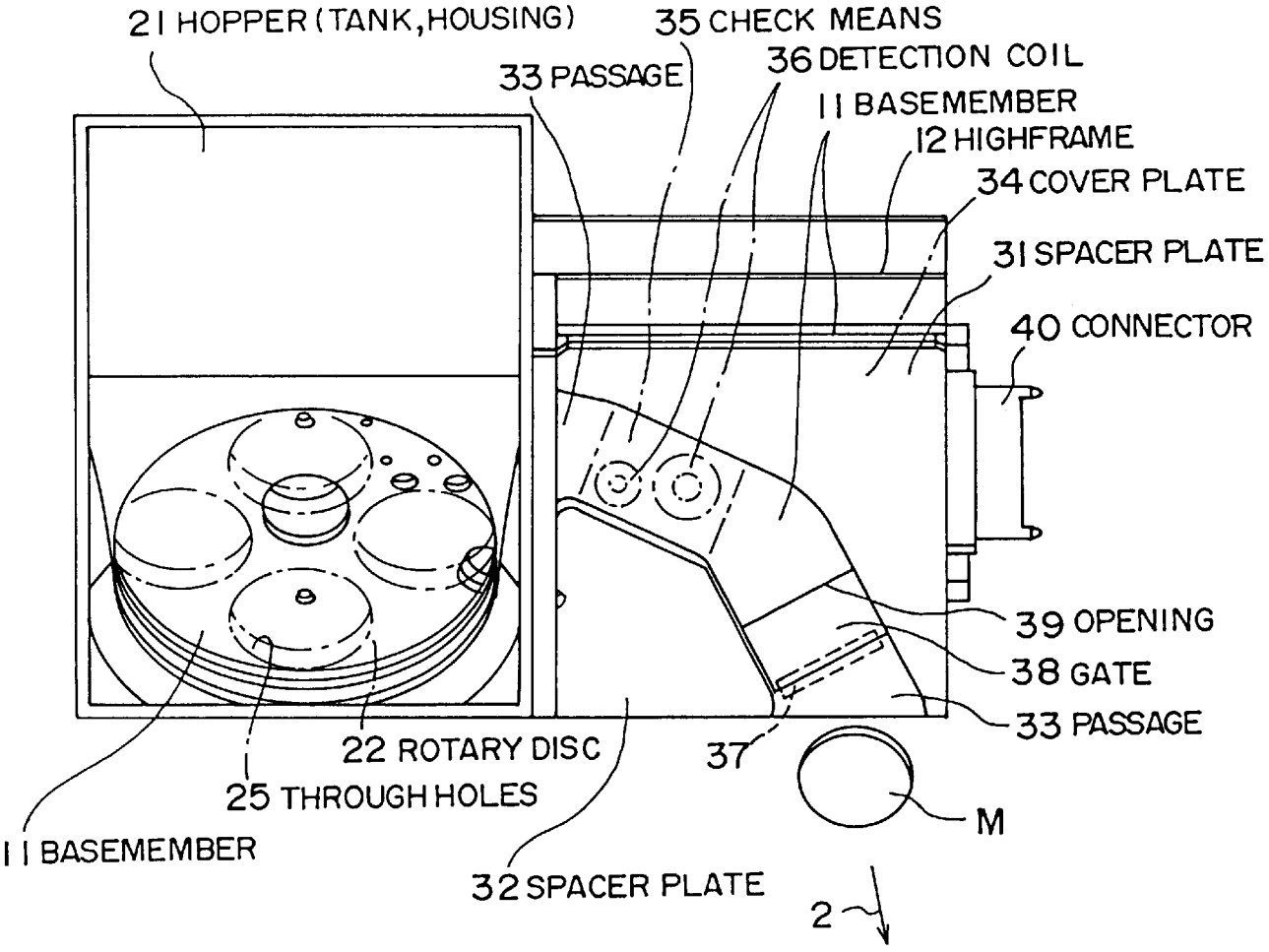
FIG. 3 FIRST METAL DISC EJECTION

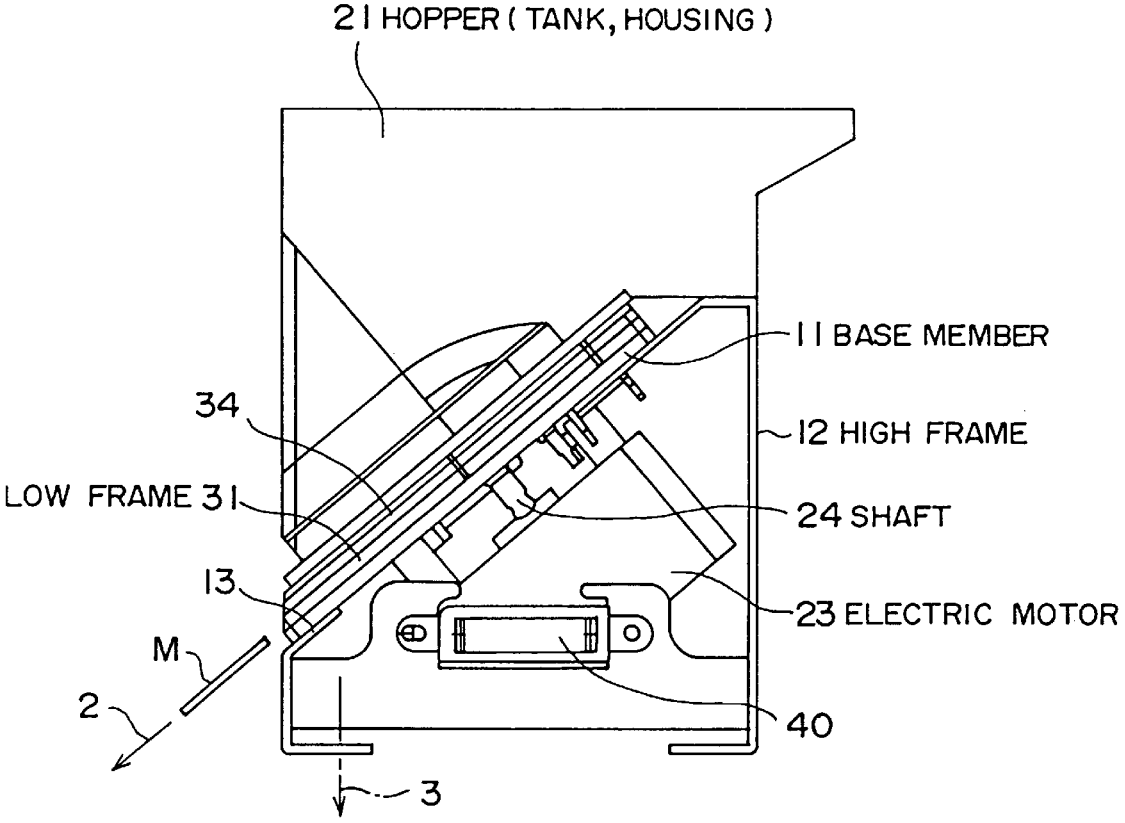
FIG. 4 FIRST METAL DISC EJECTOR

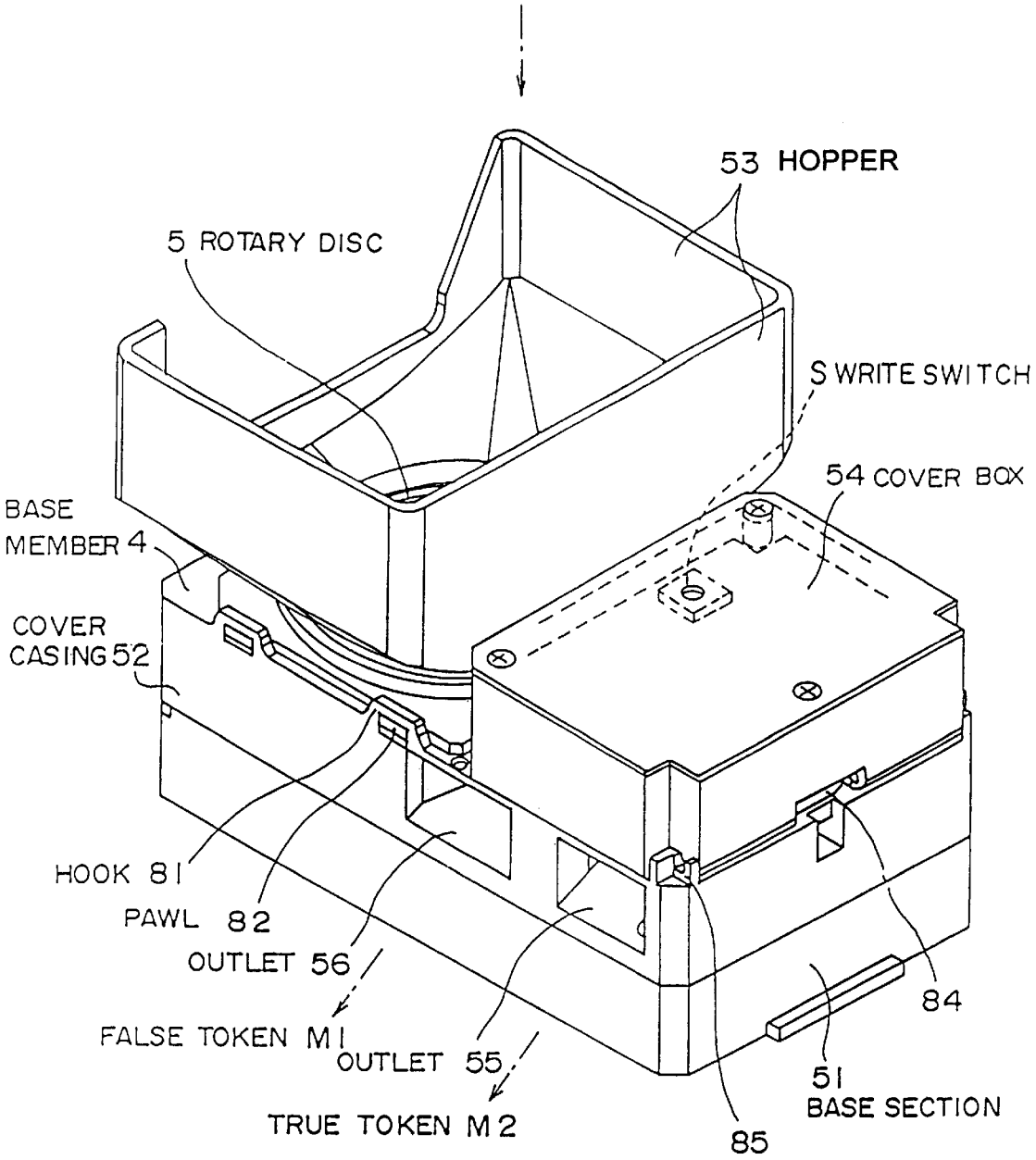
FIG. 5 SECOND METAL DISC EJECTOR ACCONDING TO THE INVENTION

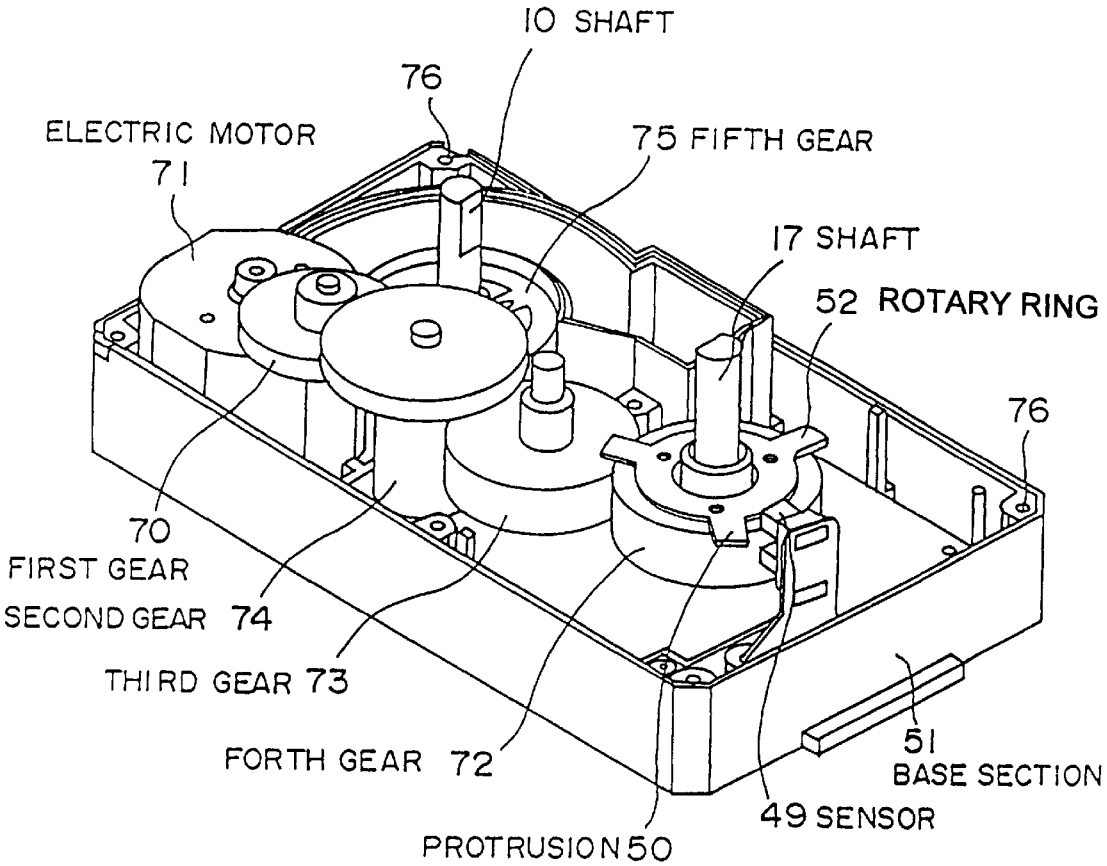
FIG. 6 BASE SECTION OF THE SECOND METAL EJECTOR

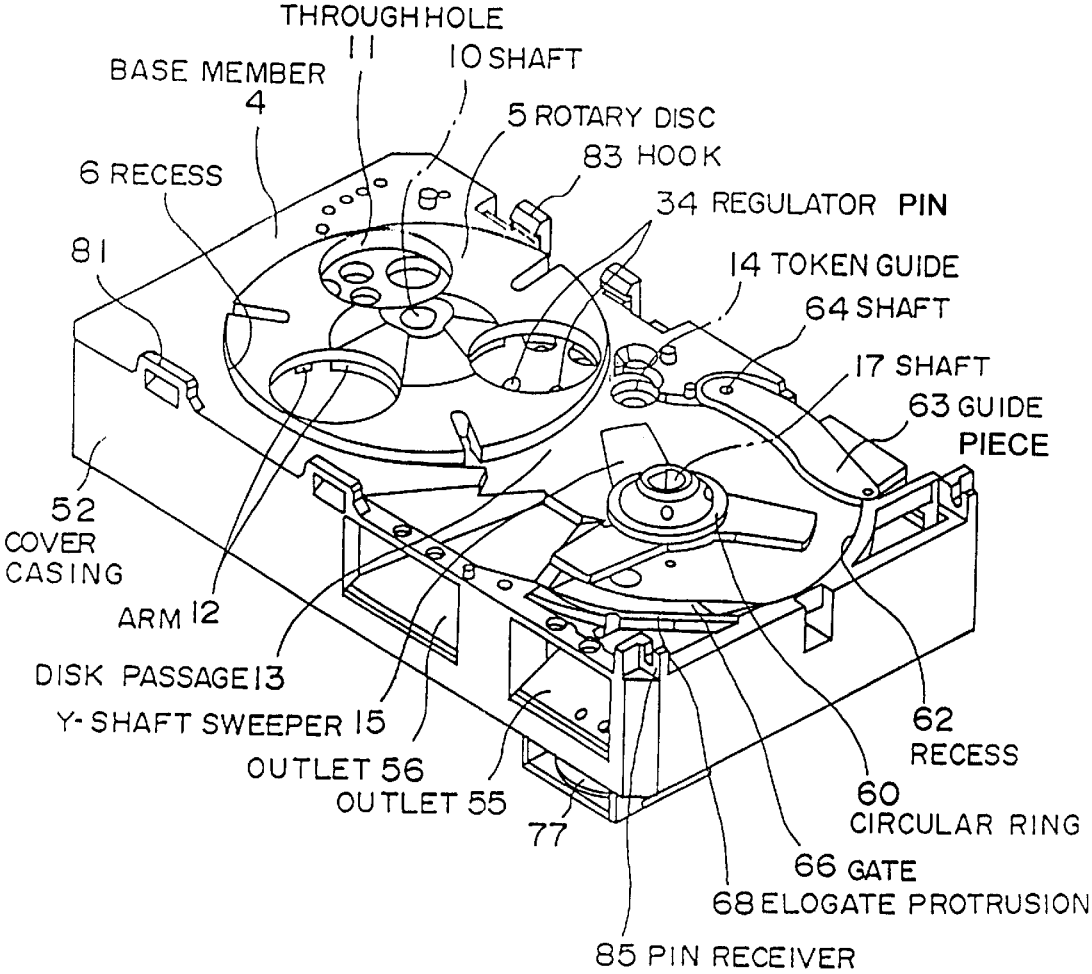
FIG. 7 COVER SECTION OF THE SECOND METAL DISC EJECTOR

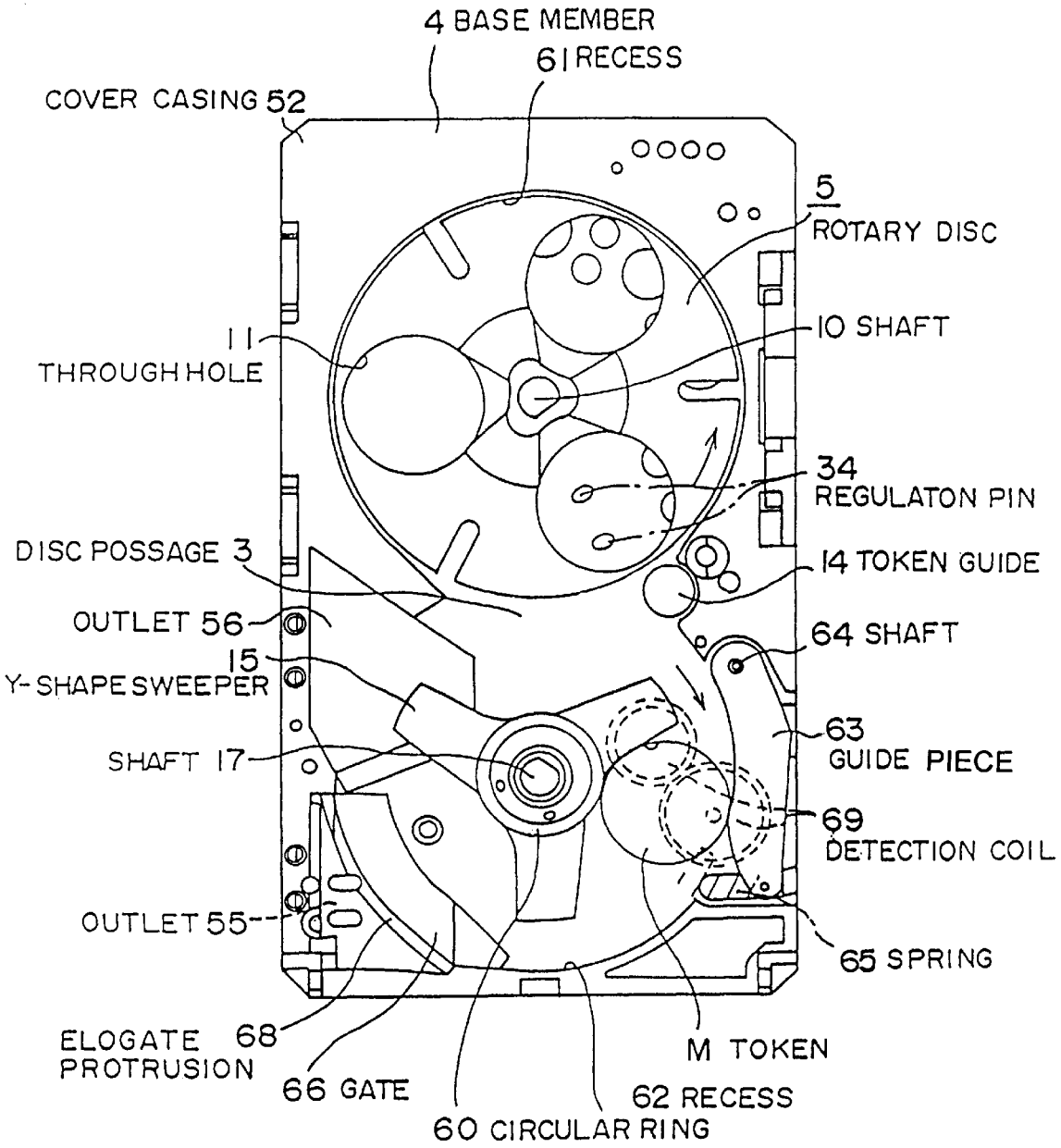
FIG. 8 COVER SECTION OF THE SECOND METAL DISC EJECTOR

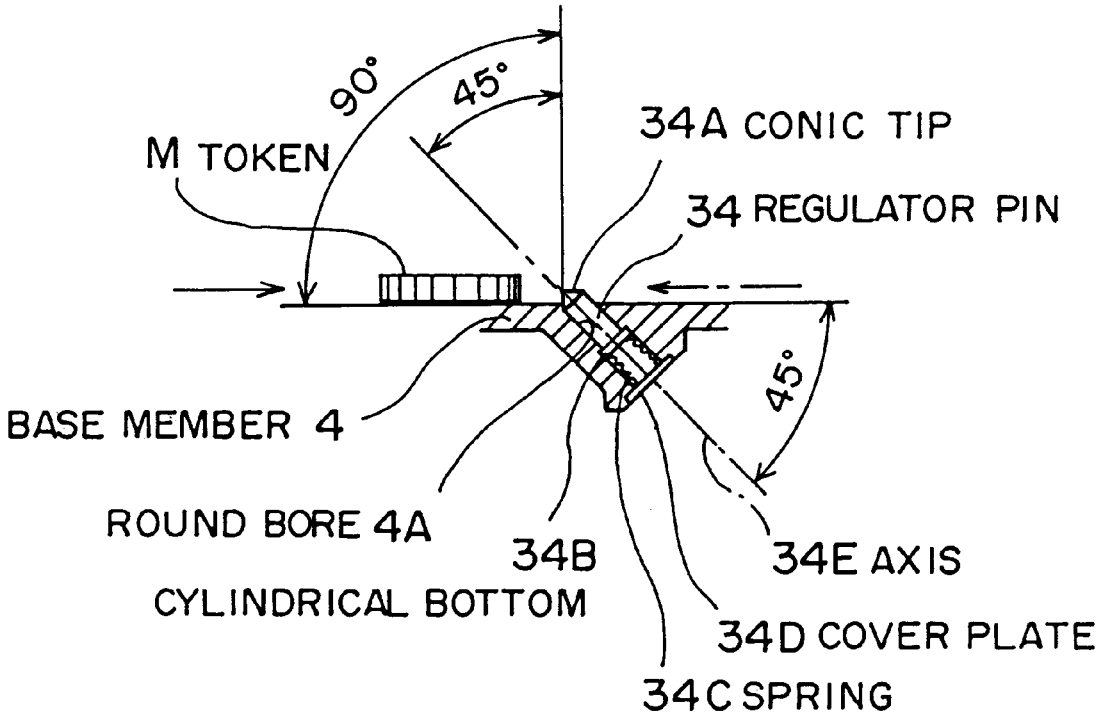
F I G. 9 REGULATOR PIN

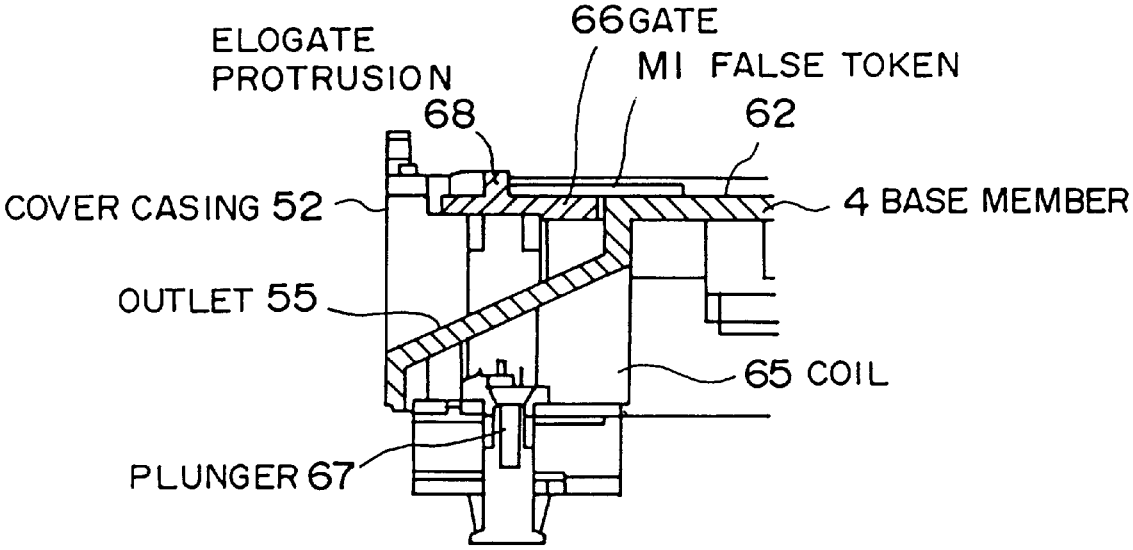
FIG.10A GATE SHOWING A CASE FOR A FALSE TOKEN
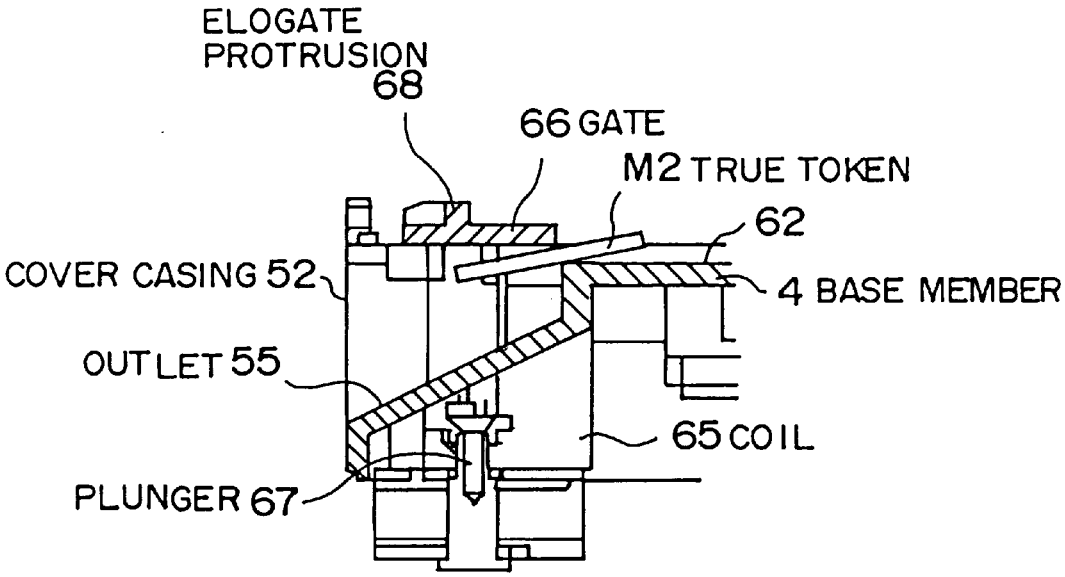
FIG.10B GATE SHOWING A CASE FOR A TRUE TOKEN

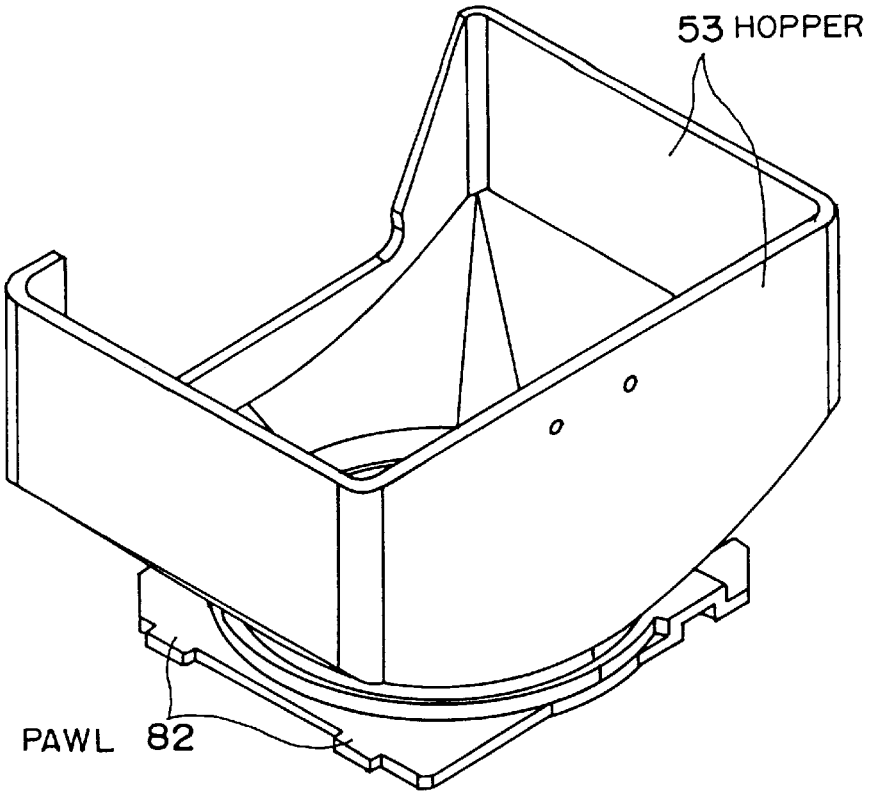
FIG.11A HEAD (HOPPER) OF THE DISC EJECTOR
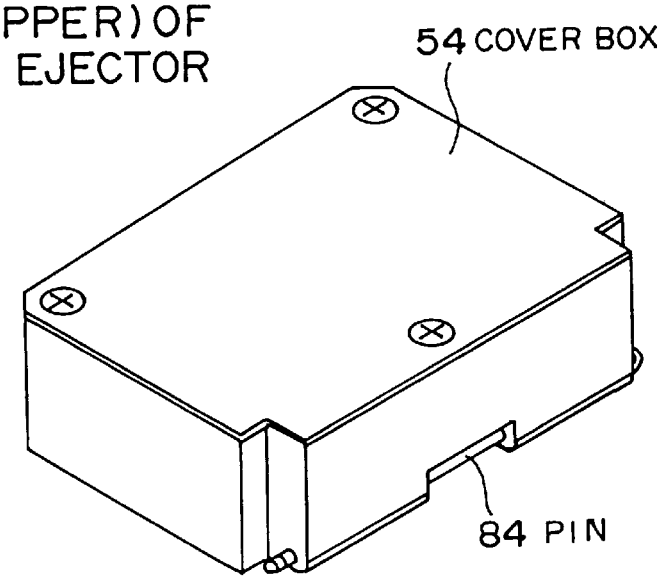
FIG.11B COVER BOX

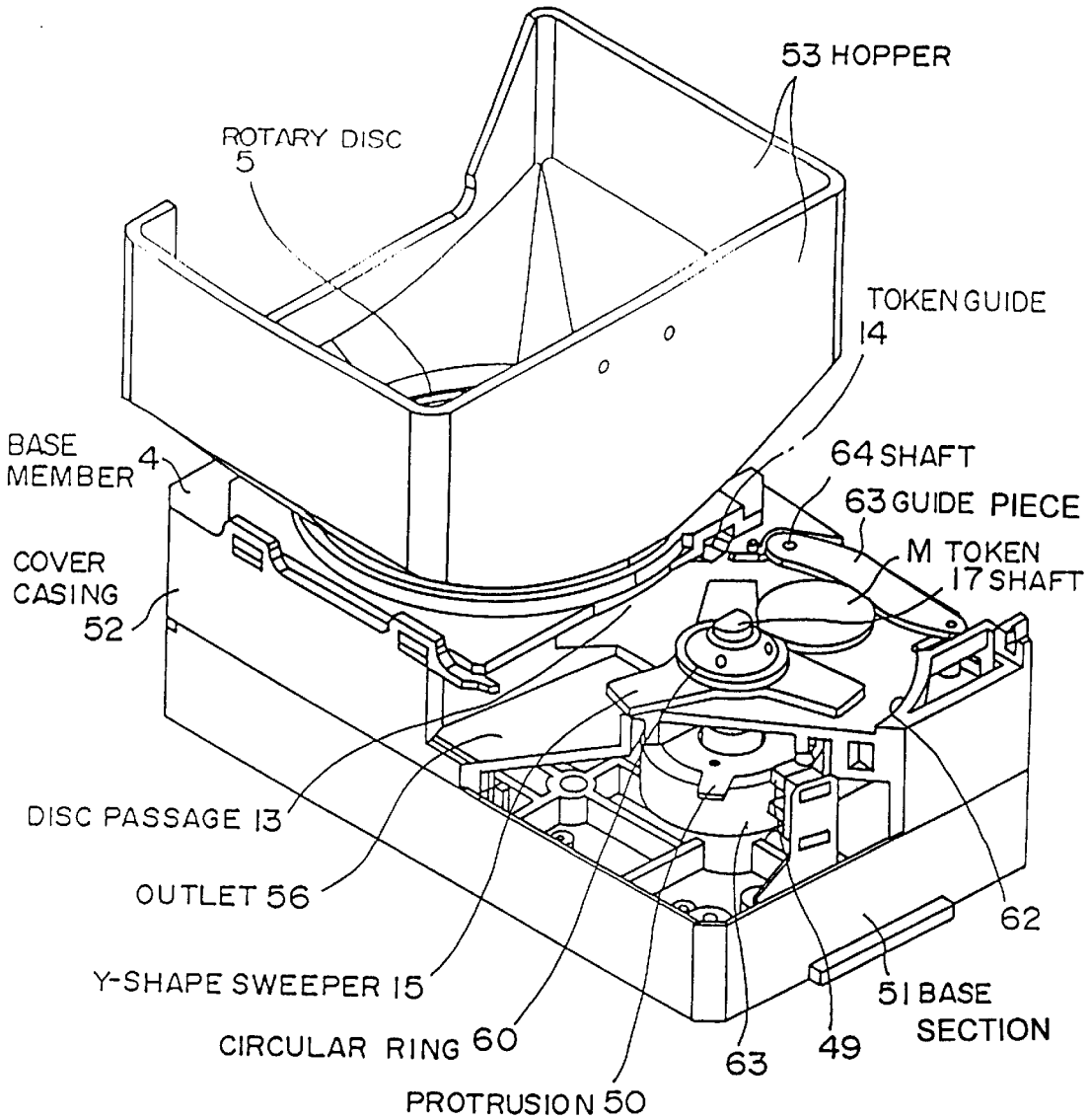
FIG.12 HEAD IS MOUNTED ON THE COVER SECTION

METAL DISC EJECTOR

FIELD OF THE INVENTION

The invention relates to a metal disc ejector for ejecting randomly piled discs one by one, and more particularly, to a metal disc ejector for selecting a specified kind of metal discs such as coins and tokens for game machines out of a randomly piled heap of discs and ejecting selected discs one by one.

BACKGROUND OF THE INVENTION

There have been known various kinds of metal disc ejectors. A typical metal disc ejector has been disclosed, for example, in Japanese Patent Publication No. 63-36040 (Application No. 60-122626), which is directed to a coin ejector.

Referring to FIG. 1, the coin ejector of the above patent publication will be described below. The ejector has a funnel shape hopper (not shown) which has a generally square opening at the top end thereof for admitting coins thrown thereinto, in a randomly piled condition. Secured at the lower end of the hopper is a case 2 in the form of hollow cylinder. The cylindrical case 2 is secured on a base plate 4. Mounted on the base plate 4 and inside the cylindrical case 2 is a rotary disc 5 for moving coins in a manner as described shortly. The rotary disc 5 is mounted on a shaft 10 which is coaxial with the cylindrical case 2. The shaft 10 of the rotary disc 5 is operably connected with a motor (not shown) so as to rotate the rotary disc 5 for sliding the coins on the base plate 4. The rotary disc 5 has a multiplicity of round throughholes 11 which are spaced apart along the circumference of the rotary disc 5 for receiving therein coins that drop from above. The rotary disc 5 keeps the coins within the throughholes while the discs are slid on a circular path on the base plate 4 to an exit 13 of the circular path, which exit is formed at one lower section of the cylindrical wall of the base plate 4.

Provided between each pair of adjacent throughholes 11 are coin feed arms 12, which extend under the rotary disc 5 and beyond the line that passes through the centers of these throughholes 11. Each of the arm 12 is adapted to push a coin sitting on the base plate 4 out of the associated throughhole and force the coin out of the throughhole when the coin has neared the exit 13. The coin taken out of the throughhole by the arm 12 is guided by a coin guide 14 out of the exit 13. The coin guide 14 is provided at a position downstream of the exit 13.

In the coin ejector shown in FIG. 1, a rotary scraper 15 is provided, with its rotary shaft located outside the cylindrical case 2. The rotary scraper 15 has the same number of radially extending feed pawls 16 as the throughholes 11 of the rotary disc. The feed pawls 16 are formed such that the tips of the pawls 16 each protrudes across an opening 13*a* which is contiguous with the exit 13 at the lower end of the cylindrical wall of the case 2. The shaft 17, and hence the scraper 15, is operably connected with the motor such that they are rotated in synchronism with the rotary disc 5 so that the coin feed arm 12 of the rotary disc 5 and the feed pawls 16 of the rotary scraper 15 cooperate within the cylindrical case 2 to advance the coin M towards the coin guide 14.

However, any of the conventional metal disc ejector such as one described above is not provided with means for determining whether a disc such as coins and tokens are genuine or not and means for removing false discs.

This has become a serious problem for many amusement houses, since they have many kinds of similar game machines which use similar but different tokens and, in addition, there are often many similar amusement houses nearby, so that it is very likely that customers deposit intentionally or unintentionally wrong tokens in the game machines.

It is therefore an object of the present invention to provide a metal disc ejector which is capable of determining whether deposited coins are genuine or not, and, in case it is not genuine, removing them from the ejector.

SUMMARY OF THE INVENTION

In one aspect of the invention, as shown in FIGS. 2 through 4, a disc ejector comprises: a hopper 21 for storing a multiplicity of deposited metal discs; a rotary disc 22 provided in the hopper, for receiving the discs and transporting the discs from the hopper towards a disc passage 33 one by one; pawl means for releasing the transported disc from the rotary disc 22 to the disc passage 33; check means 36 disposed at an upstream position of the disc passage, for testing the one disc to determine if the disc is genuine; and a gate 38 disposed at a downstream position of the disc passage and controlled by the check means, for selecting true discs.

In another aspect of the invention as shown in FIGS. 5 through 12, a disc ejector comprises: a hopper 53 for storing a multiplicity of deposited metal discs; a rotary disc 5 for trapping discs stored in the hopper one by one and transporting them through a predetermined transportation passage; means 34 for forcing the discs out of the rotary disc one by one at the exit of the transportation passage; rotary sweeper 15 for removing the discs from the rotary disc 5; means 60 and 63 for receiving the discs from the rotary sweeper and guiding the discs to a predetermined reference point; a check means 36 provided near the reference point for testing the discs passing the reference point and determine if the disc is a true one; and a gate 66 provided downstream of the reference point and controlled by the check means to select only true discs, wherein true and false discs are accordingly ejected from separate outlets.

In a further aspect of the invention as shown in FIGS. 5 through 12, a disc ejector comprises: a molded plastic base casing 51 for accommodating a pair of synchronized shafts driven in the opposite rotational directions via a gear mechanism; a molded plastic cover casing 52 including on the top thereof a Transport-Test-Selection (TTS) mechanism which has a rotary disc 5 for trapping discs stored in the hopper one by one and transporting them through a predetermined transportation passage means 34 for removing the discs one by one from the rotary disc at the exit of the transportation passage; rotary sweeper 15 for further advancing the removed disc; means 60 and 63 for receiving the discs from the rotary sweeper, for guiding the discs to a predetermined reference point; a check means 36 provided near the reference point for testing the discs passing the reference point and determine if the disc is a true one; and a gate 66 provided downstream of the reference point and controlled by the check means to select only true discs, wherein true and false discs are accordingly ejected from separate outlets; a (cylindrical) molded plastic hopper 53 removably mounted on the cover casing and adjacent to the rotary disc; and a (small) molded plastic box 54 including electronic devices for controlling the gear mechanism and the TTS mechanism.

BRIEF DESCRIPTION OF THE DRAWINGS

Preferred embodiments of the invention will now be described in conjunction with the accompanying drawings, in which:

FIG. 1 is a schematic view of a main body of a conventional disc ejector.

FIG. 2 is a perspective view of a first disc ejector according to the invention.

FIG. 3 is a front view of the metal disc ejector of FIG. 2.

FIG. 4 is a side elevational view of the metal disc ejector of FIG. 2.

FIG. 5 is a perspective view of a secondmetal disc ejector according to the invention.

FIG. 6 is a perspective view of a base section of the metal disc ejector shown in FIG. 5.

FIG. 7 is a perspective view of a cover section of the metal disc ejector shown in FIG. 5.

FIG. 8 is a front view of the cover section shown in FIG. 7.

FIG. 9 is an illustration useful in describing functions of a regulator pin shown in FIG. 8.

FIGS. 10(A) and (B) are illustrations useful in describing functions of a gate shown in FIG. 8, with FIG. 10(A) showing a case for a false token and FIG. 10(B) for a true token.

FIG. 11A illustrates details of a head (hopper) of the disc ejector of FIG. 6, and FIG. 11(B) illustrates details of a cover.

FIG. 12 illustrates how the head of FIG. 11(A) is mounted on the cover section.

DETAILED DESCRIPTION OF THE PREFERRED EMBODIMENT

Two possible embodiments of the present invention will now be described with reference to the accompanying drawings, in which like reference characters designate like or corresponding elements throughout FIGS. 2 through 12. It should be understood that, although the presently preferred embodiment of the invention has been described in connection with game machines using metal tokens, various change may be made within the scope of the appended claims. For example, the ejector may be readily modified for coins.

Referring now to FIG. 2, there is shown in perspective view a first metal disc ejector embodying the invention. FIG. 3 shows the metal disc ejector in plan view and, in FIG. 4, in side elevational view.

A large square base member 11, shown in FIGS. 2 through 4, is supported in an inclined position by a high frame 12 having a generally "7"-shaped cross section and by a low frame 13 having a generally C-shaped cross section, as shown in FIG. 4. The high frame 12 is located at the rear end, while the low frame 13 is at the front end of the housing 21, as shown in FIG. 4. In the example shown herein, the base member 11 is inclined at an angle of about 40 degrees to the horizontal plane.

A hopper 21 or tank in the form of funnel having a semi-cylindrical wall with the bottom end thereof closed and a rectangular opening at the top end thereof for allowing deposition of disc tokens (not shown) thereinto. The tokens may be accumulated randomly in the hopper.

The bottom of the tank 21 is inclined along the base member 11. Disposed on the bottom is a rotary plate or disc 22. In order to transport tokens in a manner as described below, the shaft 10 of the rotary plate or disc is operably connected with a shaft 24 of an electric motor 24 as shown in FIG. 4.

The rotary disc 22 has a multiplicity (which is 4 in the example shown in FIG. 4) of throughholes 25 which are angularly spaced apart. When tokens are, deposited in the housing 21 while the rotary disc 22 is rotating, the tokens will drop in the throughholes 25 and trapped therein, as represented by a token M shown in FIG. 4.

The rotary disc 22 is provided on the back side thereof with pawls (not shown) for forcing the tokens trapped in the througthholes 25 out of the throughholes and direct them to an exit positioned to the right of the rotary disc 22 as seen in FIGS. 2 and 3.

The tokens released from the rotary disc 22 at the exit advance in a downwardly inclined passage 33 which is contiguous with the exit of the rotary disc 22, as shown in FIGS. 2 and 3. The inclined passage 33 is an elongate recess which is defined by the lower end of a generally triangular spacer plate 31 (right upper section of FIG. 3) and the upper end of a generally square spacer plate 32 (lower left section of FIG. 3). Covering the entire regions of the spacer plates 31 and 32 and the recess is a sufficiently thick and substantially square cover plate 34, leaving the inclined passage 33 under the cover plate 34.

At an upper potion of the disc passage 33 and under the base plate 11 is a tester or check means 35 for testing the token to see if it is genuine. For example, it may comprise two detection coils 36, for example, disposed along the inclined passage 33. Each of the coils 36 is connected with an electric oscillator (not shown). When a metal token M passes by the detection coils 36, it changes the impedance of the coils 36, thereby changing the resonance frequency of the oscillator, and hence the level of the current (or detection signal) in the oscillator. The resultant change in the resonance frequency and the level of the detection signal depend on the size, thickness, and material properties of the token. Accordingly, using a comparator (not shown), the token may be determined if it is genuine or not by comparing the change caused by the token with the reference data associated with true tokens stored in a memory (not shown).

Provided at a position downstream of the check means 35 is a rectangular gate 38 for opening/closing an opening 39 formed in the disc passage 33 with a door rotatably fixed by a pivot means 37 at the lower edge of the opening 39. The gate 38 may be opened/closed by a plunger type solenoid, for example.

The gate 38 may be opened and closed in response to the signal received from the check means 35 depending upon genuineness of the token.

Shown in FIG. 2 at a lower right corner thereof is a small parallelepiped connector box 40, which houses electric terminals for the disc ejector, to be connected with an external power source.

The operational detail of the first metal disc ejector will now be described. When a switch 23 is thrown to ON position, the disc 22 begins to rotate in a counter clockwise direction as shown in FIG. 3. If a multiplicity of metal tokens are deposited in the hopper 21, they are piled randomly on the bottom of the hopper. Each of the tokens piling on the bottom of the hopper will be eventually trapped in one of the throughholes 25 of the rotary disc 22 in motion, and piles up in the throughholes. These discs are transported by the rotary disc 22 along a predetermined path, sliding on the base member 11, towards the entrance of the inclined passage 33. The lowest discs in the respective throughholes 25 are forced out of the throughholes one by one by a projecting arm (not shown) provided near the inclined passage 33.

The token forced out of the rotary disc 22 at the entrance of the disc passage 33 falls in the inclined passage 33 towards the lower right corner of FIG. 3, due to gravity. The token passing through the inclined passage 33 is tested and determined by the check means 35 if it is a true token as it passes by the check means 35.

When the token is true, the gate 38 is actuated by a signal received from the check means 35 (resulting in rotation of the gate about the pivot 37) thereby opening the gate 38. The true token M2 falling in the inclined passage 33 past the check means 35 will then drop in the direction of arrow 3 as shown in FIG. 4, and into a case for collecting true tokens (not shown) below the opening 39.

When the metal token is false, the gate 38 is not actuated, so that the false token M1 will go through the inclined passage 33 all the way down to the exit and fall in the direction of arrow 2 as shown in FIGS. 3 and 4, and into another case for collecting false tokens (not shown).

It would be appreciated that the gate 38 is actuated only when a true token is detected, so that this arrangement may prevent admission of false tokens in the case for true tokens, even when power failure should occur. When the gate 38 is inoperative, it may happen that true tokens are collected in the case for false tokens.

In stead of having an opening like the one 39, the inclined passage 33 may have a branch for separating true tokens from false ones.

Since the memory may store different reference data associated with different kinds of tokens, the disc ejector of the invention may distinguish different kinds of tokens (and coins as well) by the help of the coils 36 and gate 38.

It will be apparent to those skilled in the art that the metal disc ejector as described above may be readily applicable to coins with only minor structural modifications.

Referring now to FIG. 5, there is shown in a perspective view a second metal disc ejector of the invention. This ejector is constructed largely in three separable sections. A generally flat lowest section (referred to as base section) 51 has a casing made of a molded plastics serving as a base for the upper sections. The middle section 52 mounted on the base section 51 has a cover casing which is also made of a molded plastic resin. The housing has two outlets 55 and 56 for true tokens M2 and false tokens M1, respectively. Mounted on top of the cover casing 52 are a third section or a hopper 53 and a relatively small box 54 next to the hopper 53, which are made of molded plastics. Details of these sections will be described below in the order mentioned.

FIG. 6 shows in detail the base section 51. This section houses an electric motor 71 and a plastic gear mechanism operably connected with the motor, for driving movable elements of the ejector. The shaft 10 of a rotary disc 5 (FIG. 7) and the shaft 17 of a Y-shape sweeper (or wiper) 15 are operably connected with the motor 71 such that they are synchronized with each other to rotate in the opposite directions. Y-shape sweeper has three arms (FIG. 7).

In operation, the motor 71 transmit its power to a fourth gear 72 via a fist gear 70, a second gear 74, and a third gear 73 to rotate the shaft 17 in one direction as shown in FIG. 6, while the motor 71 rotates a fifth gear 75 engaging the motor shaft and its shaft 10 in the opposite direction as shown in FIG. 6.

Mounted on the intermediate section of the shaft 17 is a rotary ring 52 having three protrusions 50 as shown in FIG. 6. The protrusions 50 are arranged to project in between two adjacent arms of the Y-shape sweeper 15 (FIG. 7). A sensor 49 is disposed at a position where these protrusions 50 pass by while they undergo rotational motion. The sensor 49, when operably coupled with the protrusions 50, may accurately determine the rotational speed of the Y-shape sweeper 15 and hence of the shaft 17. The couple may also detect accurately the position of the token M trapped between the two arms of the Y-shape sweeper 15.

Referring again to FIG. 5, the cover casing of the middle section 52 (the casing also referred to as cover casing 52) is shown to be mounted on the base casing of the base section 51 (the casing also referred to as base casing 51). The cover casing 52 is secured to the base casing 51 by long screws threaded from below in the threaded bores at the corners of the base casing 51.

FIG. 7 shows a perspective view of the cover casing 52, along with such elements as rotary disc 5 and Y-shape sweeper 15. A plan view of the cover casing 52 is shown in FIG. 8. The cover casing 52 has a generally parallelepiped shape and may be molded from a plastic resin. As shown in these figures, the cover casing 52 has a square top plate member 4 which has a set of generally "8"-shaped recesses 61 and 62. In the upper recess 61 of FIG. 8 is the rotary disc 5 mounted on the shaft 10, while inside the lower recess 62, the plastic Y-shape sweeper 15 is rotatably mounted on the shaft 17 at the center of the recess 62.

As already described previously in connection with FIG. 6, the shaft 10 of the rotary disc 5 and the shaft 17 of the Y-shape sweeper 15 are driven by an electric motor 71 via the gear mechanism such that they are rotated in the opposite directions in synchronism with each other. (In the example shown herein, the rotary disc 5 rotates in a counter clockwise direction, and the Y-shape sweeper 15 in the clockwise direction.)

A region of the surface of the base member 4 lying between the rotary disc 5 and the Y-shape sweeper 15 is referred to as a disc passage 13. As a metal token trapped in a throughhole 11 of the rotary disc 5 is moved in the counter clockwise direction to the disc passage 13, it is released from the rotary disc 5 onto the disc passage 13, which is then trapped by the Y-shape sweeper 15, moving in the counter clockwise direction. If it is a true token M2, it will be ejected from the outlet 55, but if it is a false token M1, it is ejected from the outlet 56, as described in more detail below.

The rotary disc 5 has a multiplicity of throughholes (three throughholes are shown in this example) angularly spaced apart along the periphery of the rotary disc 5. The diameter of the throughhole 11 is slightly greater than that of the token to deal with, so that tokens may be easily trapped therein.

In order to release a token from the rotary disc 5 as the token is brought to the Y-shape sweeper 15, there is provided a protrusion under the rotary disc 5 (not shown) and a regulator pin 34. The regulator pin 34 is provided at an appropriate position near a disc passage 13 (FIG. 7) on the base member 4. The regulator pin 34 is adapted to block the token that approaches from one direction, but allow the token to pass over the regulator pin 34 without notably interfering the token if it comes from the opposite direction. Such mono-directional feature of the regulator pin 34 may be advantageously utilized in removing a disc or discs accidentally trapped in between the rotary disc 5 and the base member 4 or clogging in the disc passage 13.

As shown in FIG. 9, the regulator pin 34 has a generally bullet-like configuration having a conic tip 34A and a large cylindrical bottom 34B. The regulator pin 34 is inserted in a round bore 4A from below. The round bore 4A is formed in the plastic base member 4 at an angle of about 45 degrees relative to a horizontal plane. The bore 4A has a section which is smaller in inner diameter than the opening of the bore 4A formed in the upper surface of the base member 4, and another section larger in inner diameter than the opening. Consequently, when the regulator pin 34 is inserted from below into the round bore 4A, the conical tip of the regulator pin 34 projects out of the 4A until the large cylindrical bottom section 34B of the regulator pin 34 abuts on the smaller diameter section of the round bore 4A and stops the regulator pin 34. The lower end of the regulator pin 34 is supported by a spring 34C inserted in the large diameter section of the 4A for urging the regulator pin 34 forward. The spring 34C is in turn supported by a cover plate 34D fixed on the entrance of the round bore 4A by screws. Thus, the regulator pin 34 is normally held in position in the round bore 4A by the spring 34C, but it may be retracted against the force of the spring 34C so that the conical tip is withdrawn in the 4A.

The maximum angle that a generatrix of the cone of the conic tip 34A makes with the surface of the base member 4 is chosen to be 90 degrees. In other words, the angle subtended by the axis 34E and a generatrix of the cone and the angle of the axis 34E with respect to the surface of the base member 4 are chosen to be 45 degrees, as shown in FIG. 9. As a result, a token M approaching the tip 34A from the left will abut on the upright surface of the tip 34A and will be stopped by the regulator pin 34. On the other hand, a token M approaching the tip 34A from the right will scarcely abut on the inclined cylindrical surface of the regulator pin 34 but override it.

It will be noted that the regulator pin 34 has an axially symmetry of a bullet, having no preferential upward/downward direction in the bore 4A, so that it may be set in the base member 4 by simply inserting it into the round bore 4A.

Referring again to FIGS. 7 and 8, there is shown a rotatable token guide 14 positioned to the right of the passage 13. The token guide 14 forcibly deflects the motion of the metal token that has been released from the rotary disc 5 by the projection and the regulator pin 34, towards the axis of the Y-shape sweeper 15.

The Y-shape sweeper 15 has a circular ring 60, mounted on the shaft 17, and a set of arms which are the same in number as the throughholes 11 and radially extend from the circular ring 60. The arms are configured such that they may trap the token reaching them and transport them in a clockwise direction.

As shown in FIG. 8, there is provided a guide piece 63 to the right of the Y-shape sweeper 15. The guide piece 63 has a side which faces the Y-shape sweeper 15 and has a contour to follow the path of the token moved by the Y-shape sweeper 15. The guide piece 63 is pivoted at one end thereof on a shaft 64 fixed on the base member 4. The other end of the guide piece 63 is connected with a spring 65 which pulls the guide piece 63 towards the Y-shape sweeper 15. Consequently, the token M driven by the Y-shape sweeper 15 in the clockwise direction is urged by the guide piece 63 to abut on the circular ring 60. The circular ring 60 is thus preferably made of a metal having a high abrasion resistance.

Disposed between the Y-shape sweeper 15 and the guide piece 63, but inside the cover casing 52, are ring shaped detection coils 69, which are partly shown in FIG. 8 by phantom lines. The detection coils 69 constitute a part of an oscillator not shown in the figure. Thus, as the token passes near the detection coils 69, the impedance of the detection coils 69 is changed, so that the resonance frequency of the oscillator connected with the coils, as well as the level of the signal indicative of the detection and generated in the oscillator, is changed. It will be understood by persons of skill in the art that the changes depend on the kind of the token, that is, the change depends on the diameter, thickness, and material of the token.

In this example also, the disc ejector includes a memory for storing the resonance frequencies and the levels of the signals for different genuine metal discs. Thus, by comparing the measured frequency and the signal level obtained for the token M by the detection coils 69 with the reference data in the comparator (not shown), the detected token is determined to be genuine or not. When the detected data match the reference data, the comparator generates an ON signal for a gate 66 to open. Otherwise, the comparator generates an OFF signal to the gate 66, telling the gate not to open.

For this purpose, the disc ejector may be adapted to initialize the reference data (the changes in frequency and amplitude caused by true tokens) in the memory prior to the installation of the ejector for actual use. To do this, a given number of true discs may be deposited in the disc ejector, and have the disc ejector learn the reference data in terms of the change in frequencies and signal levels experienced for the true discs.

The token released from the guide piece 63 is then advanced by the Y-shape sweeper 15, in a clockwise direction in the recess 62 of the base member 4 towards the gate 66.

FIGS. 10(A) and (B) shows the gate in detail. As shown in FIGS. 7, 8, and 10, the gate 66 mounted above the outlet 55 for directing a true token to the outlet 55. The gate 66 has an upper surface which is maintained flush with the base member 4, and an elongate arc-shaped protrusion 68 on the upper surface. The elongate protrusion 68 is configured to help the token to be moved in the clockwise direction by the Y-shape sweeper 15, as shown in FIGS. 7 and 8. An electric servo system for controlling lifting and lowering the gate, is provided below the gate 66. The servo system includes a plunger 67 for raising and lowering the gate 66 and a solenoid for controlling the linear motion of the plunger 67.

For a genuine token M2, upon reception of the ON signal from the oscillator, the coil 65 is activated at a proper timing to lift the plunger 67 so that the gate 66 is lifted above the base member 4 as shown in FIG. 10(B), resulting in an opening for the genuine token to proceed to the outlet 55. For a false token M1, the coil 65 is not activated since then servo system receives OFF signal from the oscillator. (In this case the detection signal results in OFF.) As a result, the plunger 67 remains at rest at a position shown in FIG. 10(A), so that the false coin M2 gets pushed by the Y-shape sweeper 15 over the flat surface of the gate 66 and along the elongate curved protrusion 68. The false token will be ejected from the outlet 56. It will be recalled that the gate 66 is opened only when a true token is detected. This is to prevent any false token from going to the outlet 55.

Referring back to FIG. 5, the hopper 53 is shown on the left corner of the cover casing 52. The box 54 is removably mounted on the right corner of the cover casing 52. FIG. 11(A) shows the hopper 53 in a perspective view. The hopper 53 is provided at one lower end thereof with two pawls 82 which engage hooks 81 (FIG. 7) formed on one end of the cover casing 52. Similarly the hopper 53 is provided at the other lower end thereof with two pawls 83 (not shown) which engage respective hooks 83 (FIG. 7) provided at the corresponding upper end of the cover casing 52. Thus, the hopper 53 may be secured in position on the cover casing 52 when these pawls engage the hooks, as shown in FIG. 12

FIG. 11(B) shows the cover box 54 in detail. The box 54 is made of molded plastics. Inside the box 54 is a write switch S for writing reference data representing genuine tokens (FIG. 5) and a printed circuit board (not shown) which carries a set of electronic elements such as a CPU for controlling the metal disc ejector. Formed on the lower end of the cover box 54 is a pin 84 to be received in a pin receiver 85 formed on the upper end of the cover casing 52 (FIG. 7). With these pin and pin receiver, the cover box 54 may be properly positioned and fixed on the cover casing 52.

The operation of the second disc ejector of the invention will now be described below. First, a given number of genuine token, for example 16 tokens, are charged in the disc ejector by depositing them in the hopper 53. Next, the write switch S is turned ON. This causes the reference data for genuine tokens M2 to be input to the memory. Subsequently, arbitrary tokens are allowed to be deposited in the hopper 53. These tokens are trapped, one by one, in the throughholes 11 of the disk 5 rotating at the bottom of the hopper 53. The tokens sitting in the throughholes are moved on the base member 4 in the counter clockwise direction as viewed in FIG. 8, until it is forced by the projection of the base member 4 (not shown) and the regulator pin 34 out of the throughholes 11 and into the passage 13.

The token M advancing on the passage 13 along the guide 14 is eventually trapped in between a pair of two arms of the Y-shape sweeper 15, and is further advanced on a predetermined path to the detection coils 69 while the token is pushed by the guide piece 63 against the circular ring 60. When the token passes by the detection coils 69, it is tested as described previously. A signal representing the result of the test is provided to the gate 66.

When the token is true, the gate 66 is opened, so that the token is ejected from the outlet 55. Timing for opening the gate is determined by a token position finder, which may be a pawl 50 coupled with a sensor 49 for sensing the position of the token (FIG. 12). On the other hand, when the token is false, the gate 66 is not opened, so that the token is further moved over the gate 66 and is ejected from the outlet 56.

Thus, the second disc ejector as described above has a simple structure and is yet capable of determining genuineness of the tokens used. Since this disc ejector may determine accurately the position of a token passing by the detection coils, it is possible to obtain accurate data of the token.

It should be appreciated that major elements of the second example may be advantageously fabricated by molding of a plastic resin and hence that the disc ejector has a fewer separate elements, which implies that a light weight, simple, and low cost disc ejector may be manufactured. In addition, such disc ejector is easier to assemble compared to the first example.

The regulator pin 34 is advantageously designed in an axially symmetric bullet-like configuration, so that it may be set correctly in the round bore 4A by simply inserting it without being bothered by the rotational angle of the regulator pin 34 in the round bore 4A.

What is claimed is:

1. A disc ejector comprising:

a base member defining a recess:

a rotary plate positioned in said recess for forcing discs one by one;

a regulator pin for guiding said forced discs radially outwardly, wherein said regulator pin has a conic tip whose axis is inclined less than 90° with respect to said rotary plate.

2. The disc ejector according to claim 1, wherein the angle of said inclination of said axis of said regulator pin is substantially 45° degrees.

3. The disc ejector according to claim 1, wherein said regulator pin has a shape of bullet.

4. The disc ejector according to claim 1, wherein said regulator pin has a shape of bullet having a conic tip and a larger flat bottom.

5. The disc ejector in accordance with claim 1, wherein:

said axis of said regulator pin is inclined at an angle to said rotary disc, and said pawl is shaped, to block movement of one of the plurality of discs in a first direction and to pass movement of the one disc in a second direction substantially opposite said first direction.

6. A disc ejector comprising:

a base member defining first and second recesses and defining a disc passage in communication with said first and second recesses;

a hopper arrange with said first recess of said base member and receiving a plurality of discs;

a rotary plate positioned in said hopper and said first recess, said rotary plate moving the plurality of discs adjacent to said disc passage one at a time;

a pawl positioned in said hopper and arranged with said rotary plate for moving the plurality of discs from said rotary plate into said disc passage and said second recess of said base member;

a rotary sweeper positioned in said second recess and individually receiving the plurality of discs from said rotary plate and said disc passage said rotary sweeper being provided with a part of a means for determining rotational motion of said sweeper;

means for receiving the discs from said rotary sweeper and guiding the discs to a predetermined reference point;

a tester positioned adjacent said reference point testing each of the plurality of discs as each of the plurality of discs pass said reference point;

a gate positioned downstream of said reference point and selecting individual ones of the plurality of discs dependent on a result of said tester.

7. The disc ejector according to claim 6, wherein said means for guiding said discs to a predetermined reference point is formed in said rotary sweeper.

8. The disc ejector according to claim 6, wherein said means for guiding said discs to a predetermined reference point is provided with a guide which has one end pivoted and the other end is urged by a spring towards said rotary sweeper.

9. The disc ejector according to claim 6, wherein said part of the means for determining rotational motion is a ring having radial projections.

10. The disc ejector according to claim 6, wherein said discs are tokens for game machines.

11. The disc ejector according to claim 6, wherein said discs are coins.

12. The disc ejector in accordance with claim 6, wherein:

said pawl has a longitudinal axis inclined at an angle to said rotary disc, and said pawl is shaped, to block movement of one of the plurality of discs in a first direction and to pass movement of the one disc in a second direction substantially opposite said first direction.

13. A disc ejector comprising:

a base member defining first and second recesses and defining a disc passage in communication with said first and second recesses;

a hopper arrange with said first recess of said base member and receiving a plurality of discs;

a rotary plate positioned in said hopper and said first recess, said rotary plate moving the plurality of discs adjacent to said disc passage one at a time;

a pawl positioned in said hopper and arranged with said rotary plate for moving the plurality of discs from said rotary plate into said disc passage and said second recess of said base member;

a rotary sweeper positioned in said second recess and individually receiving the plurality of discs from said rotary plate and said disc passage said rotary sweeper being provided with a part of a means for determining rotational motion of said sweeper;

means for receiving the discs from said rotary sweeper and guiding the discs to a predetermined reference point said means for guiding said discs to a predetermined reference point being formed in said rotary sweeper;

a tester positioned adjacent said reference point testing each of the plurality of discs as each of the plurality of discs pass said reference point;

a gate positioned downstream of said reference point and selecting individual ones of the plurality of discs dependent on a result of said tester.

* * * * *